US005811382A

United States Patent [19]

Damhus et al.

[11] Patent Number: 5,811,382

[45] Date of Patent: Sep. 22, 1998

[54] DETERGENT COMPOSITIONS

[75] Inventors: Ture Damhus; Egon Nielsen, both of Copenhagen; Dorrit Anita Aaslyng, Roskilde, all of Denmark

[73] Assignee: Novo Nordisk A/S, Bagsvaerd, Denmark

[21] Appl. No.: 211,903

[22] PCT Filed: Dec. 10, 1992

[86] PCT No.: PCT/DK92/00383

§ 371 Date: Apr. 26, 1994

§ 102(e) Date: Apr. 26, 1994

[87] PCT Pub. No.: WO93/13193

PCT Pub. Date: Jul. 8, 1993

[30] Foreign Application Priority Data

Dec. 20, 1991 [WO] WIPO ..... PCT/DK91/00406

[51] Int. Cl.[6] ..... C11D 3/386; C11D 3/395

[52] U.S. Cl. ..... 510/392; 510/530; 510/226; 510/305; 510/306; 510/309

[58] Field of Search ..... 252/174.12, DIG. 12; 435/220, 221, 222, 223, 224, 225, 188; 510/393, 530, 226, 305, 306, 309

[56] References Cited

U.S. PATENT DOCUMENTS

| | | | |
|---|---|---|---|
| 4,421,664 | 12/1983 | Anderson et al. | 252/94 |
| 4,421,668 | 12/1983 | Cox et al. | 252/174.12 |
| 4,927,558 | 5/1990 | Aaslyng | 252/174.12 |
| 5,260,207 | 11/1993 | Pantoliano et al. | 435/221 |
| 5,312,748 | 5/1994 | Liu et al. | 435/220 |
| 5,354,681 | 10/1994 | Liu et al. | 435/200 |

FOREIGN PATENT DOCUMENTS

| | | |
|---|---|---|
| WO 8803947 | 6/1988 | WIPO . |
| WO 8909813 | 10/1989 | WIPO . |
| 9105839 | 5/1991 | WIPO . |
| WO 9105839 | 5/1991 | WIPO . |

*Primary Examiner*—Kerq A. Fries
*Attorney, Agent, or Firm*—Steve T. Zelson; Elias J. Lambiris

[57] ABSTRACT

The invention relates to a detergent additive and a detergent composition which comprises a protease enzyme derived from Nocardiopsis, a surfactant, and either/or an enzyme which exhibits peroxidase activity and hydrogen peroxide or precursor thereof or an oxidase enzyme which acts on an aromatic compound.

18 Claims, No Drawings

DETERGENT COMPOSITIONS

CROSS-REFERENCE TO RELATED APPLICATIONS

This application is a 371 of PCT/DK92/00383 filed Dec. 18, 1992, the contents of which are incorporated herein by reference.

TECHNICAL FIELD

The present invention relates to the use of proteases derived from members of the genus Nocardiopsis in detergent additives or compositions, or wash liquors, comprising specific bleaching systems.

BACKGROUND ART

Bleaching systems have been suggested for incorporation into detergent compositions in order to obtain bleaching effects on stained fabric, or in order to prevent transfer of a textile dye from a dyed fabric to another fabric during washing or rinsing.

Detergent compositions or wash liquors comprising a bleaching system have been described in e.g. International Patent Publications WO 89/09813 and WO 91/05839. Bleaching systems as described herein comprise enzymes exhibiting peroxidase activity and hydrogen peroxide or a precursor thereof, or enzymes exhibiting a suitable oxidase activity.

A major drawback in applying such bleaching systems to detergent compositions is that proteases present in such compositions may be strongly affected by the bleaching systems, thereby hampering the washing performance of the detergent composition.

Some members of the genus Nocardiopsis are known to produce proteases. In International Patent Application WO 88/03947, alkaline proteases obtainable from protease producing strains of Nocardiopsis have been described for their use as detergent additives, in particular as detergent additives for cold water laundering.

SUMMARY OF THE INVENTION

We have now surprisingly found that proteases derived from members of the genus Nocardiopsis are more stable in the presence of the above mentioned bleaching systems than other detergent proteases.

Accordingly, the present invention provides a detergent composition comprising a protease derived from a member of the genus Nocardiopsis, and: (a) an enzyme exhibiting peroxidase activity and hydrogen peroxide or a precursor thereof, and/or (b) an enzyme exhibiting a suitable oxidase activity.

In another aspect, the invention provides a detergent additive comprising a protease derived from a member of the genus Nocardiopsis, and: (a) an enzyme exhibiting peroxidase activity and hydrogen peroxide or a precursor thereof, and/or (b) an enzyme exhibiting a suitable oxidase activity.

DETAILED DISCLOSURE OF THE INVENTION

The present invention relates to proteases derived from members of the genus Nocardiopsis, which proteases according to the invention have proved to be stable in the presence of peroxidase based bleaching systems.

More specifically, the invention relates to the use of proteases derived from members of the genus Nocardiopsis in cleaning processes, e.g. household laundering, industrial and institutional laundering or cleaning, and dish washing, or fabric cleaning processes, in which processes solutions containing enzymes exhibiting peroxidase activity, or enzymes exhibiting suitable oxidase activity, are used for the purpose of either bleaching stains on surfaces in contact with the solutions, or inhibiting the transfer of a textile dye from a dyed fabric to another fabric.

The present invention provides detergent compositions comprising proteases derived from a member of the genus Nocardiopsis, and enzymes exhibiting peroxidase activity together with hydrogen peroxide or a precursor thereof, or alternatively enzymes exhibiting a suitable oxidase activity.

The invention also provides detergent additives comprising proteases derived from a member of the genus Nocardiopsis, and enzymes exhibiting peroxidase activity together with hydrogen peroxide or a precursor thereof, or alternatively enzymes exhibiting a suitable oxidase activity.

Optionally, the detergent additive or detergent composition also contains accelerators.

Nocardiopsis Proteases

Microorganisms belonging to the actinomycete Nocardiopsis are well known in the literature. Some examples of species and strains described are *N. dassonvillei*, Type Strain ATCC 23218; *N. dassonvillei* M58-1 (NRRL 18133), WO Pat. Publ. 88/03947; *N. dassonvillei* ZIMET 43647, DD Pat. Publ. 200,432; *N. dassonvillei* subsp. prasina, Agric.Biol.Chem. (54, 8, 2177-79) 1990; *N. sp.* OPC 120, JP Pat. Appl. 2,255,081; and *N. sp.* 10R (NRRL 18262WO Pat. Publ. 88/03947.

Proteases derived from members of the actinomycete Nocardiopsis are disclosed in e.g. International Patent Application WO 88/03947 and GDR Patent No. DD 200,432. Proteases obtainable from the Nocardiopsis are alkaline proteases.

Preferably, the proteases are derived from a protease producing strain of *N. dassonvillei*, preferably the strain ZIMET 43647, more preferred the strain *N. dassonvillei* M58-1 (NRRL 18133), or from a protease producing strain of the species defined by the strain 10R, more preferred the strain *Nocardiopsis sp.* 10R (NRRL 18262).

The strains *N. dassonvillei* M58-1 and *Nocardiopsis sp.* 10R are described in the above mentioned International Patent Application WO 88/03947, and accordingly have been deposited under the terms of the Budapest Treaty, at the Agricultural Research Culture Collection (NRRL), Peoria, US (NRRL 18133 was deposited on Nov. 13, 1986; NRRL 18262 was deposited on Nov. 10, 1987).

The strain ZIMET 43647 is described in the above mentioned DD Patent No. 200,432.

In a more preferred embodiment, proteases are derived from a protease producing strain of Nocardiopsis that is characterized by having optimal pH for growth at about pH 9, by having essentially no growth below pH 8, by having optimal temperature for growth at 20°–30° C., by essentially no growth above 35° C., and by belonging to *N. dassonvillei*, preferably *N. dassonvillei* M58-1 (NRRL 18133), or the strain ZIMET 43647, or to the species defined by the strain 10R, preferably *Nocardiopsis sp.* 10R (NRRL 18262).

In another preferred embodiment, the protease is an alkaline protease preparation derived from Nocardiopsis, preferably a strain of *N. dassonvillei*, more preferred the strain *N. dassonvillei* M58-1 (NRRL 18133), or to the species defined by the strain 10R, preferably *Nocardiopsis*

*sp.* 10R (NRRL 18262), characterized by having at least 60% of its maximum activity in the pH range of from pH 7 to 11, measured with casein as substrate.

Suitable protease dosages may be in the range 0.0001 to 10 mg of enzyme protein per liter of washing liquor, preferably 0.001 to 1 mg of enzyme protein per liter of washing liquor. In detergent compositions, suitable protease dosages may be in the range of 0.005 μg to 30 mg of enzyme protein per g of detergent composition, preferably 0.05 μg to 3 mg of enzyme protein per g of detergent composition, more preferred 0.1 μg to 100 μg of enzyme protein per g of detergent composition.

Enzyme Exhibiting Peroxidase Activity

Enzymes exhibiting peroxidase activity are understood to indicate enzymes with a mode of action similar to that of a peroxidase (EC 1.11.1.7; according to the Recommendations of the Nomenclature Committee of the International Union of Biochemistry), and will be used synonymously therewith.

Peroxidases suitable for incorporation into detergent additives or compositions of the invention have been described in e.g. the previously mentioned International Patent Application Nos. WO 89/09813 and WO 91/05839, which peroxidases are hereby incorporated by reference.

Peroxidases to be employed for the present purpose may be isolated from and are producible by plants (e.g. horseradish peroxidase), or microorganisms, particularly bacteria or fungi, e.g actinomycetes or basidiomycetes, preferably derived from a strain of Coprinus, preferably *C. cinereus.*

Other useful peroxidases are haloperoxidases such as chloro or bromo peroxidases.

Peroxidases may also be producible by methods comprising cultivating a host cell transformed with a recombinant DNA vector carrying a DNA sequence encoding said enzyme as well as DNA sequences encoding functions permitting the expression of the enzyme, in a culture medium under conditions permitting the expression of the enzyme and recovering the enzyme from the culture.

Preferably, the peroxidase is active at in the range of pH 6.5 to 12, more preferred pH 6.5 to 10.5, and most preferred pH 7.5 to 10.5.

Suitable peroxidase dosages may be in the range of 0.01 to 100 mg/l of wash liquor, more preferred 0.1 to 10 mg/l, most preferred 0.1 to 1 mg/l. In detergent compositions, suitable peroxidase dosages may be in the range of 0.5 μg to 300 mg enzyme protein per g of detergent composition, preferably 5 μg to 30 mg of enzyme protein per g of detergent composition, more preferred 50 μg to 3 mg of enzyme protein per g of detergent composition.

Hydrogen Peroxide or Precursors

When the enzyme used in the bleaching system is a peroxidase, hydrogen peroxide or a precursor of hydrogen peroxide, preferably perborate or percarbonate, will typically be added. It may, however, be desirable to utilize an enzymatic process for the formation of hydrogen peroxide.

One such category of hydrogen peroxide generating systems comprises enzymes which are able to convert molecular oxygen and an organic or inorganic substrate into hydrogen peroxide and the oxidized substrate, respectively.

Preferred hydrogen peroxide-generating enzymes are those which act on cheap and readily available substrates which may conveniently be included into detergent additives or compositions. An example of such a substrate is glucose which may be utilized for hydrogen peroxide production by means of glucose oxidase. Other suitable oxidases are urate oxidase, galactose oxidase, alcohol oxidases, amine oxidases, amino acid oxidase, and cholesterol oxidase.

Optimal hydrogen peroxide concentrations in wash liquors are within the range of 1 μM to 20 mM, preferably 1 μM to 1 mM. When using Coprinus peroxidase, 0.01 to 0.25 mM hydrogen peroxide is preferred.

Enzymes Exhibiting Oxidase Activity

In the context of this invention, enzymes exhibiting oxidase activity are understood to indicate enzymes with a similar mode of action to that of an oxidase, and are meant to be synonymous therewith in the following.

Examples of enzymes exhibiting a suitable oxidase activity are oxidases which act on aromatic compounds, in particular phenolic, e.g. polyphenolic, are catechol oxidase (EC 1.10.3.1) or laccase (EC 1.10.3.2).

Accelerators

It has been found that the addition of certain oxidizable substances at the beginning of, or during the washing and/or rinsing process, may enhance the dye transfer inhibitory effect of the peroxidase system employed. Such substances are termed enhancers or accelerators, since they generally increase the initial rate of the reaction between peroxidase/hydrogen peroxide and textile dyes.

Examples of potential accelerators are metal ions, e.g. $Mn^{++}$, halide ions, e.g. chloride or bromide ions, or organic compounds such as phenols, e.g. p-hydroxybenzoic acid, p-hydroxycinnamic acid, 2,4-dichlorophenol, p-hydroxybenzenesulfonic acid, 7-hydroxycoumarin, or vanillin, or those given in M. Kato and S. Shimizu, *Plant Cell Physiol.* 26(7), 1985, pp. 1291–1301 (cf. Table 1 in particular) or in B.C. Saunders et al., op. cit., p. 141 ff.

Optimal accelerator concentration in wash liquors is within the range of 1 μM to 1 mM, preferably 5 to 100 μM.

Detergent Additives And Detergent Compositions

The detergent composition of the invention may comprise one or more surfactants which may be of an anionic, non-ionic, cat-ionic, amphoteric or zwitterionic type, or a mixture of these. Typical examples of anionic surfactants are linear alkyl benzene sulfonates (LAS); alkyl sulfates (AS); alpha olefin sulfonates (AOS); alcohol ethoxy sulfates (AES) and alkali metal salts of natural fatty acids. Examples of non-ionic surfactants are alkyl polyethylene glycol ethers; nonylphenol polyethylene glycol ethers; fatty acids esters of sucrose and glucose; and esters of polyethoxylated alkyl glucoside.

The detergent composition of the invention may also contain other detergent ingredients known in the art such as builders, anti-corrosion agents, sequestering agents, anti soil-redeposition agents, perfumes, stabilizers for the enzymes and bleaching agents, formulations aids, optical brighteners, foam boosters, chelating agents, fillers, fabric softeners, etc. The detergent composition of the invention may be formulated substantially as described in Falbe, J.; Surfactants in Consumer Products. Theory, Technology and Application; Springer Verlag 1987, vide in particular the section entitled "Frame formulations for liquid/powder heavy-duty detergents".

The detergent compositions of the invention can be formulated in any convenient form such as powders, liquids, etc. Generally, detergent compositions are used in dosages within the range of 0.3 to 15 g of detergent per liter of wash liquor.

The detergent composition of the invention may advantageously include one or more other enzymes, e.g. lipases, amylases, cellulases, conventionally included in detergent compositions, as well as proteases of other origin.

The enzymes according to the invention may be included in a detergent composition by adding separate additives containing one or more enzymes, or by adding a combined additive comprising all of these enzymes.

The additive of the invention, whether being a separated additive or a combined additive, can be formulated e.g. as granulates, liquids, slurries, etc. Preferred detergent additive formulations are non-dusting granulates, liquids, in particular stabilized liquids, slurries, or protected enzymes. Dust free granulates may be produced according to e.g. GB Patent No. 1,362,365 or US Patent No. 4,106,991, and may optionally be coated by methods known in the art. The enzymes may be mixed before or after granulation. Liquid enzyme preparations may, for instance, be stabilized by adding a polyol such as e.g. propylene glycol; a sugar or sugar alcohol; lactic acid or boric acid, according to established methods. Other enzyme stabilizers are well known in the art. Protected enzymes may be prepared according to the method disclosed in EP Patent Application No. 238,216.

The following example further illustrates the present invention, and is not intended to be in any way limiting to the scope of the invention as claimed.

EXAMPLE

Wash Performance

This example illustrates protease wash performance in the presence of an accelerated peroxidase system in comparison with the wash performance in the absence of this peroxidase system.

The wash performance tests were accomplished on grass juice soiled cotton at 35° C., isothermically for 15 minutes.

1 g/l of a commercial American type phosphate-based powder detergent without bleach was used. The detergent was dissolved in approximately 6° dH (German hardness) water. pH in the wash liquor was 8.5. The textile/wash liquor ratio was approximately 3.5 g of textile (2.3 g of soiled and 1.2 g of clean textile) per liter of detergent solution.

Proteases were dosed to 0, 0.3, and 0.5 mg of enzyme protein per liter. The protease preparation was obtained from *Nocardiopsis sp.* 10R according to International Patent Publication WO 88/03947, which publication is hereby included by reference.

In one set of tests peroxidase 0.4 mg/l, 50 $\mu$M sodium p-hydroxybenzenesulfonate (as accelerator), and 0.2 mM $H_2O_2$ (in the Tables below collectively referred to as the POD-system), and protease were added to the detergent solution prior to addition of soiled textile. The peroxidase used was derived from *Coprinus cinereus*, and obtained according to the method described in pending EP Patent Application No.. 91610022.

In another set of tests only the protease was added to the detergent solution prior to addition of soiled textile.

Subsequent to washing, the fabric was rinsed in running tap water and air-dried. The protease performance was determined by the change (AR) of the remission (%R) at 460 nm measured on a Datacolor Elrephometer 2000, ΔR being the remission after wash with protease added minus the remission after wash with no protease added.

The results of these comparative tests are presented in Tables 1 and 2 below.

TABLE 1

Wash performance (ΔR) in the presence and in the absence of the POD-system.

| | POD-system present | | POD-system absent | |
|---|---|---|---|---|
| Protease Dosage (mg/l) | 0.3 | 0.5 | 0.3 | 0.5 |
| Nocardiopsis protease | 8.5 | 12.4 | 11.7 | 15.4 |
| Alcalase ™1) | 0.4 | 0.7 | 17.3 | 18.8 |
| Savinase ™1) | 2.8 | 4.4 | 9.3 | 11.6 |
| Durazym ™1) | 3.6 | 4.5 | 13.8 | 16.0 |

1) Alcalase ™, Savinase ™, Durazym ™ are trademarks for commercial detergent proteases, supplied by Novo Nordisk A/S, Denmark. The proteases are all alkaline Bacillus proteases.

From Table 1 it appears that the Nocardiopsis protease is significantly less affected by the presence of the bleaching system than are the Bacillus proteases.

These results are also illustrated by Table 2 below. In this table, the stability of the Nocardiopsis proteases is presented as the wash performance of the proteases in the presence of the bleaching system relative to the corresponding performance in the absence of this system.

TABLE 2

Wash performance in the presence of the POD-system, relative to the wash performance in the absence of the POD-system

| | % Wash Performance | |
|---|---|---|
| Protease Dosage (mg/l) | 0.3 | 0.5 |
| Nocardiopsis protease | 73 | 81 |
| Alcalase ™ | 2 | 4 |
| Savinase ™ | 30 | 38 |
| Durazym ™ | 26 | 28 |

From Table 2 it appears that in the presence of the bleaching system the Nocardiopsis protease maintains approximately ¾ or more of its wash performance in the absence of this bleaching system, whereas the Bacillus proteases loose most of their wash performance in the presence of the bleaching system.

We claim:

1. A detergent composition comprising (a) a protease obtained from Nocardiopsis, (b) one or both (i) an enzyme exhibiting peroxidase activity and hydrogen peroxide or a precursor thereof and (ii) an oxidase enzyme which acts on aromatic compounds, and (c) a surfactant.

2. The detergent composition of claim 1, wherein the protease is obtained from *N. dassonvillei.*

3. The detergent composition of claim 2, wherein the protease is obtained from *N. dassonvillei* M58-1 (NRRL 18133).

4. The detergent composition of claim 2, wherein the protease is obtained from ZIMET 43647.

5. The detergent composition of claim 1, wherein the protease is obtained from *Nocardiopsis sp.* 10R (NRRL 18262).

6. The detergent composition of claim 1, wherein the enzyme exhibiting peroxidase activity is horseradish peroxidase, or a peroxidase obtained from Coprinus.

7. The detergent composition of claim 1, further comprising an accelerator.

8. The detergent composition of claim 7, wherein the accelerator is selected from the group consisting of metal ion, a halide ion, p-hydroxybenzoic acid, p-hydroxycinnamic acid, 2,4-dichlorophenol, p-hydroxybenzenesulfonate, 7-hydroxycoumarin, and vanillin.

9. The detergent composition of claim 1, comprising both (i) an enzyme exhibiting peroxidase activity and hydrogen peroxide or a precursor thereof and (ii) an enzyme exhibiting a suitable oxidase activity.

10. A detergent additive comprising (a) a protease obtained from Nocardiopsis, and (b) one or both (i) an enzyme exhibiting peroxidase activity and hydrogen peroxide or a precursor thereof, and (ii) an oxidase enzyme which acts on aromatic compounds.

11. The detergent additive of claim 10, wherein the protease is obtained from *N. dassonvillei*.

12. The detergent additive of claim 11, wherein the protease is obtained from *N. dassonvillei* M58-1 (NRRL 18133).

13. The detergent additive of claim 11, wherein the protease is obtained from the strain ZIMET 43647.

14. The detergent additive of claim 10, wherein the protease is obtained from *Nocardiopsis sp.* 10R (NRRL 18262).

15. The detergent additive of claim 10, wherein the enzyme exhibiting peroxidase activity is horseradish peroxidase, or a peroxidase obtained from Coprinus.

16. The detergent additive of claim 10, further comprising an accelerator.

17. The detergent additive of claim 16, wherein the accelerator is selected from the group consisting of metal ion, a halide ion, p-hydroxybenzoic acid, p-hydroxycinnamic acid, 2,4-dichlorophenol, p-hydroxybenzenesulfonate, 7-hydroxycoumarin, and vanillin.

18. The detergent additive of claim 10, comprising both (i) an enzyme exhibiting peroxidase activity and hydrogen peroxide or a precursor thereof and (ii) an enzyme exhibiting a suitable oxidase activity.

* * * * *

UNITED STATES PATENT AND TRADEMARK OFFICE

CERTIFICATE OF CORRECTION

PATENT NO. : 5,811,382

DATED : September 22, 1998

INVENTOR(S) : Damhus et al.

It is certified that error appears in the above-identified patent and that said Letters Patent is hereby corrected as shown below:

On the title page,

Item [22]: delete "Dec. 10, 1992" and insert --Dec. 18, 1992--

Col. 2, line 31: delete "18262WO" and insert --18262), WO--

Col. 5, line 62: delete "(AR)" and insert --(ΔR)--

Signed and Sealed this

First Day of June, 1999

*Attest:*

Q. TODD DICKINSON

*Attesting Officer*

*Acting Commissioner of Patents and Trademarks*